US007878349B2

(12) United States Patent
Wimmer

(10) Patent No.: US 7,878,349 B2
(45) Date of Patent: Feb. 1, 2011

(54) PROFILE SHAPE FOR A CRANE BOOM

(75) Inventor: Eckhard Wimmer, Hallein (AT)

(73) Assignee: Palfinger AG, Bergheim (AT)

( * ) Notice: Subject to any disclaimer, the term of this patent is extended or adjusted under 35 U.S.C. 154(b) by 0 days.

(21) Appl. No.: 12/718,314

(22) Filed: Mar. 5, 2010

(65) Prior Publication Data

US 2010/0155356 A1 Jun. 24, 2010

Related U.S. Application Data

(63) Continuation of application No. PCT/AT2008/000309, filed on Aug. 29, 2008.

(30) Foreign Application Priority Data

Sep. 5, 2007 (AT) ..... GM528/2007

(51) Int. Cl.
*B66C 23/04* (2006.01)

(52) U.S. Cl. ..... 212/348

(58) Field of Classification Search ..... 212/348, 212/349, 350

See application file for complete search history.

(56) References Cited

U.S. PATENT DOCUMENTS 4,459,786 A * 7/1984 Pitman et al. ..... 52/115
5,884,791 A * 3/1999 Vohdin et al. ..... 212/348
6,098,824 A * 8/2000 Krebs et al. ..... 212/347
6,189,712 B1 * 2/2001 Conrad et al. ..... 212/292
6,499,612 B1 * 12/2002 Harrgington et al. ..... 212/350
6,978,907 B2 * 12/2005 Paschke ..... 212/348

(Continued)

FOREIGN PATENT DOCUMENTS

DE 2 317 595 10/1974

(Continued)

OTHER PUBLICATIONS

International Search Report issued Dec. 16, 2008 in International (PCT) Application No. PCT/AT2008/000309.

(Continued)

*Primary Examiner*—Thomas J. Brahan
(74) *Attorney, Agent, or Firm*—Wenderoth, Lind & Ponack L.L.P.

(57) ABSTRACT

The invention relates to a crane jib for a crane, having a longitudinal axis and an imaginary contour line that extends in a transversal plane relative to an axis of symmetry in an at least approximately mirror-symmetric manner. The contour line has an at least approximately arcuate section between a center that is equally interspaced from the first and second point of intersection on the axis of symmetry and the first point of intersection, and a first straight section is tangentially contiguous thereto in the direction of the second point of intersection. The imaginary extension of the first straight section in the direction of the second point of intersection intersects the axis of symmetry and forms an acute angle therewith. A second straight section is tangentially contiguous to the approximately arcuate section in the direction of the first point of intersection and extends up to the axis of symmetry and forms an angle of less than 90 degrees with the axis of symmetry in the first point of intersection in the interior of the surface enclosed by the contour line.

23 Claims, 6 Drawing Sheets

U.S. PATENT DOCUMENTS

| | | | | |
|---|---|---|---|---|
| 7,413,093 | B2 * | 8/2008 | Richter et al. | 212/348 |
| 7,578,402 | B2 * | 8/2009 | Paschke | 212/348 |
| 2004/0168997 | A1 * | 9/2004 | Irsch et al. | 212/195 |
| 2006/0204152 | A1 * | 9/2006 | Brinkmann et al. | 384/35 |

FOREIGN PATENT DOCUMENTS

| | | | |
|---|---|---|---|
| DE | 30 15 599 | | 10/1981 |
| EP | 0 583 552 | | 2/1994 |
| EP | 0 668 238 | A1 * | 8/1995 |
| EP | 0 814 050 | | 12/1997 |
| EP | 1 319 760 | | 6/2003 |

OTHER PUBLICATIONS

Austrian Search Report issued Jun. 4, 2008 in GM 528/2007.

* cited by examiner

PROFILE SHAPE FOR A CRANE BOOM

This application is a continuation application of International application PCT/AT2008/000309, filed Aug. 29, 2008, the entire disclosure of which is incorporated herein by reference.

BACKGROUND OF THE INVENTION

The present invention concerns a crane boom for a crane, the crane boom having a longitudinal axis and a contour line extending in a transverse plane relative to an axis of symmetry in mirror-symmetrical relationship. The contour line has between a point arranged on the axis of symmetry equidistantly relative to the first and second intersection points and the first intersection point an at least approximately arcuate portion which is tangentially adjoined in the direction of the second intersection point by a first straight portion whose notional extension in the direction of the second intersection point intersects the axis of symmetry and includes an acute angle therewith.

Such a crane boom is shown for example in FIG. 13 of EP 583 552 B1.

A disadvantage is that production of the arcuate portion is complicated and expensive and cannot be easily carried out in an error-free manner.

SUMMARY OF THE INVENTION

The object of the invention is to provide an improved crane boom, and that object is attained by a crane boom having the features described below.

It will be appreciated that a real crane arm has both an outside contour and an inside contour by virtue of the material thickness of the components forming it. The 'notional contour line' refers to the outside contour of the crane boom.

The invention affords good weldability of the crane boom, better suitability for clamping for the welding operation by virtue of the portions which meet each other at an incline, and the implementation of a longitudinal weld seam without additional edge preparation. Overall, that affords a configuration which is more reliable in terms of process implementation.

Further advantageous embodiments are defined in the appendant claims.

The term 'centroid' is used in the context of this disclosure to denote the center of gravity of the overall region enclosed by the notional contour line. The term 'centroid' is therefore not to be interpreted in relation to the area enclosed between the outside and inside contours.

The invention further concerns a jib system for a crane, wherein at least one jib and/or jib extension is in the form of a crane boom as shown and described. Preferably there are provided between one and twenty, preferably between five or ten, jib extensions. It is particularly preferable for more than five jib extensions to be provided.

The invention further concerns a crane, in particular a loading crane, having a crane boom according to one of the aforementioned embodiments or a jib system of the aforementioned kind as well as a utility vehicle equipped with such a crane.

BRIEF DESCRIPTION OF THE DRAWINGS

Further advantages and details of the invention will be apparent from the Figures and the related specific description. In the Figures.

It will be presupposed that all Figures are true to scale insofar as the lengths of the individual contour portions and the illustrated angles are shown in the correct ratio to each other. All angle references relate to degrees, so that a full angle corresponds to 360 degrees. An angle of less than ¼ full angle is interpreted as an acute angle. An angle of greater than ¼ and less than ½ full angle is interpreted as an obtuse angle. An angle equal to ¼ full angle is identified as a right angle.

DETAILED DESCRIPTION OF THE INVENTION

Figure 1D:
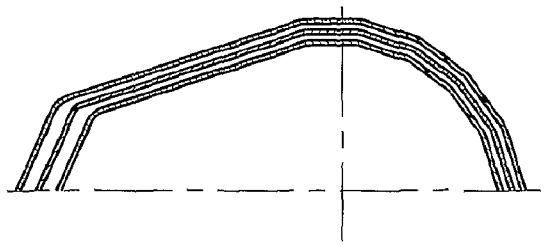
FIG. 1*d* shows a jib system having three jib extensions as shown in FIG. 1*b*.
Figure 1C:
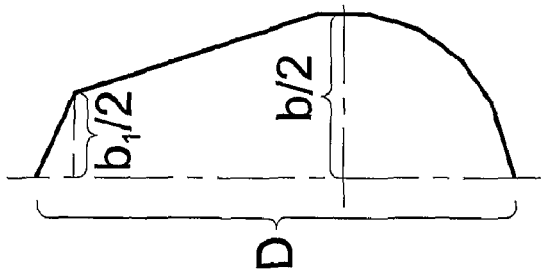
FIGS. 1*b* and 1*c* show the construction of a contour line (FIG. 1*b*) and the corresponding sheet metal structure (FIG. 1*c*) of an embodiment in which the arcuate portion $k_1$ is approximated by a polygonal line.
Figure 1B:
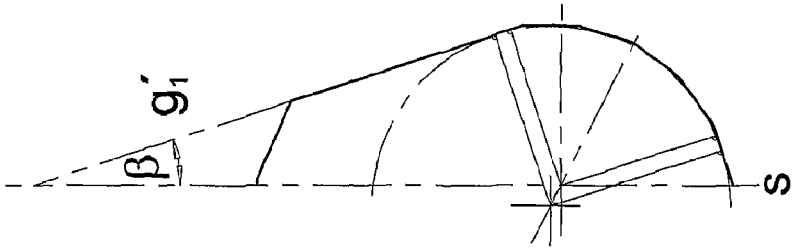
Figure 1A:
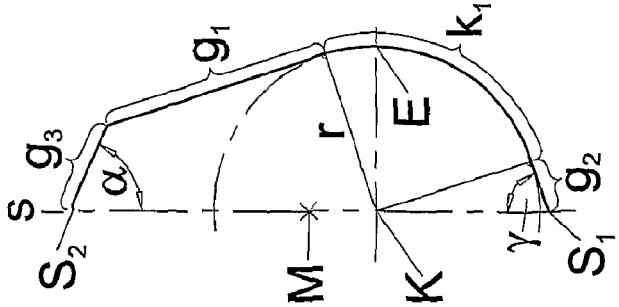
FIG. 1*a* shows a first embodiment of the notional contour line of a crane boom according to the invention.

FIG. 1*a* shows a first embodiment of the configuration of the notional contour line of the crane boom in a transverse plane of the crane boom. In this respect, the term 'transverse plane' is used to identify a plane through which the longitudinal axis of the crane boom passes in orthogonal relationship. All crane booms according to the invention have an axis of symmetry s which is arranged in the transverse plane and in relation to which the contour line of the crane boom extends in the transverse plane in at least approximately mirror-image relationship. For the situation, where the crane boom is of the same cross-sectional shape over a large part of or its entire longitudinal extent, that axis of symmetry s represents the straight section line of the transverse plane with the plane of symmetry extending along the longitudinal axis (median plane). In all embodiments, the contour line intersects the axis of symmetry s at first and second intersection points $S_1$, $S_2$. The center point M arranged on the axis of symmetry s equidistantly relative to the first and second intersection points $S_1$, $S_2$ represents the position of half the height of the crane boom in the transverse plane. Starting from the center point M in the direction of the intersection point $S_2$, that affords a region of the crane boom which, in operation, is predominantly subjected to a tensile loading. The region of the crane boom, that is between the center point M and the first intersection point $S_1$, is substantially subjected to a compression loading in operation.

The configuration of the contour line of the crane boom shown in FIG. 1 has four portions $k_1$, $g_1$, $g_2$, $g_3$ which can be distinguished from each other.

The portion $k_1$ which is arranged in the region of the compression loading that is greatest in operation is of an arcuate configuration since, as is known per se, that cross-sectional shape has reduced compression stresses and involves a reduction in the risk of buckling. It is sufficient if that portion is at least approximately arcuate in the sense that it can be approximated by a polygon, as is shown in FIGS. 1*b* and 1*c*. Approximation of the arcuate portion $k_1$ by a polygon permits easier manufacture by folding of the metal sheets forming the crane boom. It will be appreciated, however, that an arcuate configuration can be implemented by means of a rolling operation.

The arcuate portion $k_1$ can also be only approximately arcuate in the sense that it can be formed for example by one or more ellipse portions of suitably slight eccentricity. It would also be possible to envisage a configuration for the arcuate portion $k_1$ by arranging in joining relationship suitably short straight, elliptical and/or arcuate segments.

As shown in FIG. 1 it is particularly advantageous if the arcuate portion $k_1$ is in the form of a quarter-circle arc, that is to say it extends over an angle of about 90 degrees. It is possible in that way for the large part of the configuration of the contour line between the first intersection point $S_1$ and the point M to be produced in the form of an arcuate portion $k_1$. The variant shown in FIG. 1 is particularly preferred, in which the center point of curvature K of the arcuate portion $k_1$ is in the proximity of or on the axis of symmetry s and the center point of curvature K of the arcuate portion $k_1$ is between the first intersection point $S_1$ and the center point M.

As shown in FIG. 1, a second straight portion $g_2$ tangentially adjoins the arcuate portion $k_1$ in the direction of the first intersection point $S_1$, the second portion including an angle $\gamma$ of less than 90 degrees with the axis of symmetry s (here the angle $\gamma$ is about 72 degrees). That affords good weldability of the crane boom, better suitability for clamping for the welding operation by virtue of the portions which meet each other at an incline and the possibility of producing a longitudinal weld seam without additional edge preparation. Overall, that affords a configuration which is more reliable in terms of process implementation.

The angle is preferably less than 80 degrees. Preferably the angle $\gamma$ is greater than 70 degrees.

In the FIG. 1 embodiment, the center point of curvature K of the arcuate portion $k_1$ is disposed directly on the axis of symmetry s between the center point M and the first intersection point $S_1$. Unlike the situation shown, the center point of curvature K can also be displaced somewhat relative to the axis of symmetry s. It should however always be in the region between the center point M and the first intersection point $S_1$.

The first straight portion $g_1$ adjoins the arcuate portion $k_1$ in the direction of the second intersection point $S_2$ tangentially to the auxiliary circle illustrated in FIGS. 1*a* and 1*b*, the first portion $g_1$ extending over the large part of the contour configuration between the center point M and the second intersection point $S_2$. That straight configuration which is extended in length in the upper region of the crane boom and the resulting narrowing in cross-section forms a zone which is better suited than in the state of the art to carrying the tensile forces occurring here and the bearing and reaction forces which occur when arranged in a jib system. The notional extension $g_1'$ of the straight portion $g_1$ (see FIG. 1*b*) includes with the axis of symmetry s an acute angle $\beta$ which in the illustrated embodiment is about 18 degrees. Quite generally, the acute angle $\beta$ can also be in a range of greater than 10 degrees, preferably greater than 15 degrees. In that respect, an upper limit of 25 degrees is preferred in each case in order to exclude an excessively shallow configuration in respect of the straight portion $g_1$.

In the embodiment shown in FIG. 1, a third straight portion $g_3$ directly adjoins the first straight portion $g_1$, the third portion g3 extending as far as the axis of symmetry s and intersecting it at the second intersection point $S_2$. As can be seen in particular in FIG. 1*c*, for reasons relating to manufacturing technology, it may be desirable if the third straight portion $g_3$ (unlike the situation shown in FIG. 1*a*) is connected to the first straight portion $g_1$ not directly but by way of a preferably curved further portion.

In the FIG. 1 embodiment, the third straight portion $g_3$ includes with the axis of symmetry s an angle $\alpha$ which is smaller than 90 degrees (in the FIG. 1 embodiment the angle $\alpha$ is about 65 degrees). A range for the angle $\alpha$ of less than 70 degrees is particularly preferred. The angle $\alpha$ in this embodiment should however be larger than 60 degrees.

Figure 2:
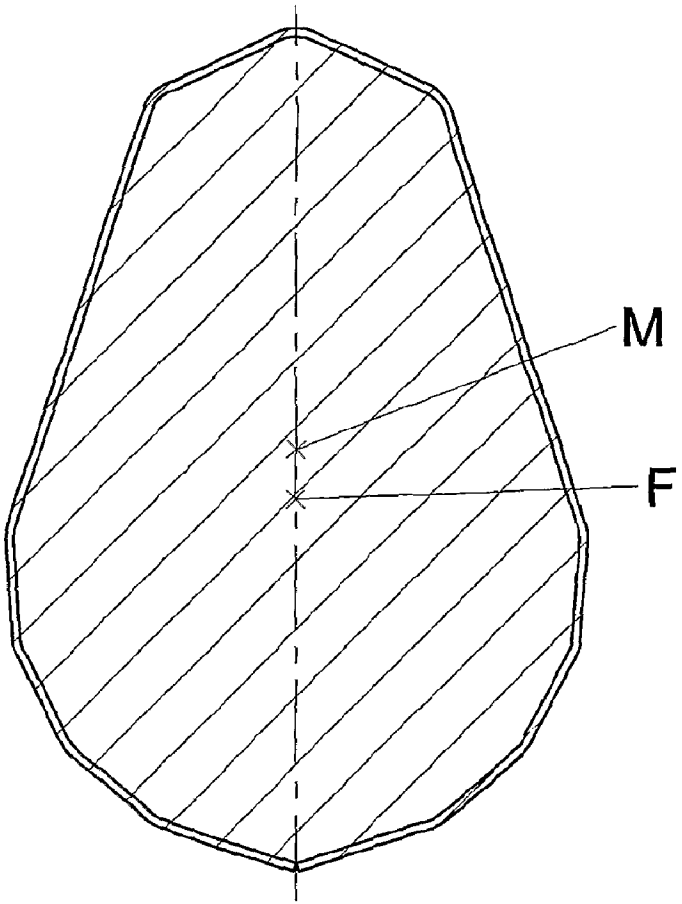
FIG. 2 shows the crane boom of FIGS. 1*a* through 1*c* and 1*e*, wherein that area to which the centroid relates has been shown in dash-dotted lines representatively for all embodiments.

In a further embodiment as shown in FIG. 2, the second straight portion includes a right angle with the axis of symmetry s.

The third straight portion $g_3$ affords the advantage that this arrangement, in the region around the tip of the crane boom, permits favorable local application of forces, as occurs for example when supporting slide packets between individual jib extensions. More specifically, the short limb length affords a favorable relationship between the sheet metal thickness and the limb length so that deformation of the crane boom is prevented in the upper region.

Figure 3:
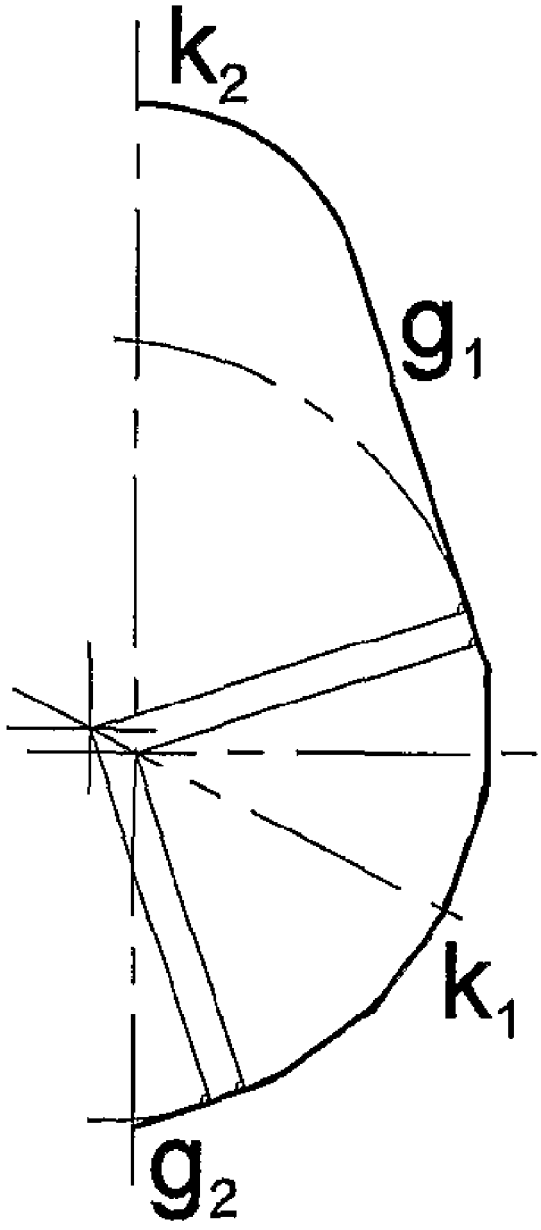
FIG. 3 shows a second embodiment of the notional contour line of a crane boom according to the invention.

It will be noted however that basically it would also be possible for the contour configuration in that region to be in the form of a second arcuate portion $k_2$ (see FIG. 3). That however only represents a special variant of a more general idea, namely the idea that the contour line ends in a rounded configuration at the line of symmetry s. As an alternative to the illustrated configuration of the rounded configuration in the form of an arcuate portion $k_2$, the rounded configuration could for example also be in the form of an edge configuration 7.

Quite generally it must be said in relation to all illustrated configurations that the centroid F of the area enclosed by the contour line in the transverse plane lies in a region between the center point M and the first intersection point $S_1$, that is to say below half the height of the crane boom. That provides that the cross-section concentration of the crane boom is displaced as much as possible downwardly into the compression zone, thereby affording a lower compression stress component.

As can be seen from the Figures, the contour line of all embodiments has, between the first intersection point $S_1$ and the second intersection point $S_2$, an extreme point E at maximum distance e from the axis of symmetry S. The spacing D between the first intersection point and the second intersection point $S_1$, $S_2$ can in that case be at least twice as great as the distance e. Preferably, the spacing D is at least two and a half times as great, particularly preferably 2.75 times as great, as the distance e. The spacing D can be in each case less than three times the distance e.

It can be provided that the spacing d of the contour line from the axis of symmetry s, at approximately a quarter of the spacing D between the first and second intersection points $S_1$, $S_2$, starting from the second intersection point $S_2$, is less than or equal to 0.8 times the maximum distance e.

In the FIG. 1 embodiment, the extreme point E is between the center point M and the first intersection point $S_1$ approximately at the height of the center point of curvature K. In the FIG. 1*a* configuration, the contour line has only one single extreme point E, that is to say the width of the crane boom decreases both in the direction of the first intersection point $S_1$ and also in the direction of the second intersection point $S_2$, starting from the extreme point E. When the arcuate portion $k_1$ is approximated by a polygonal line, as shown in FIG. 1*c*, it will be appreciated that all points on the polygonal portion, by which the arcuate portion $k_1$ is approximated in the region of the extreme point E, involve that maximum distance e.

Starting from the auxiliary circle shown in FIG. 1*a*, of the radius r, the embodiment of FIG. 1 involves a profile width b in accordance with b~2r, a profile height D in accordance with D~3r and a profile width upward $b_1$ in accordance with $b_1$~r. Those particularly advantageous dimensions can be provided quite generally in crane booms according to the invention.

Figure 1F:
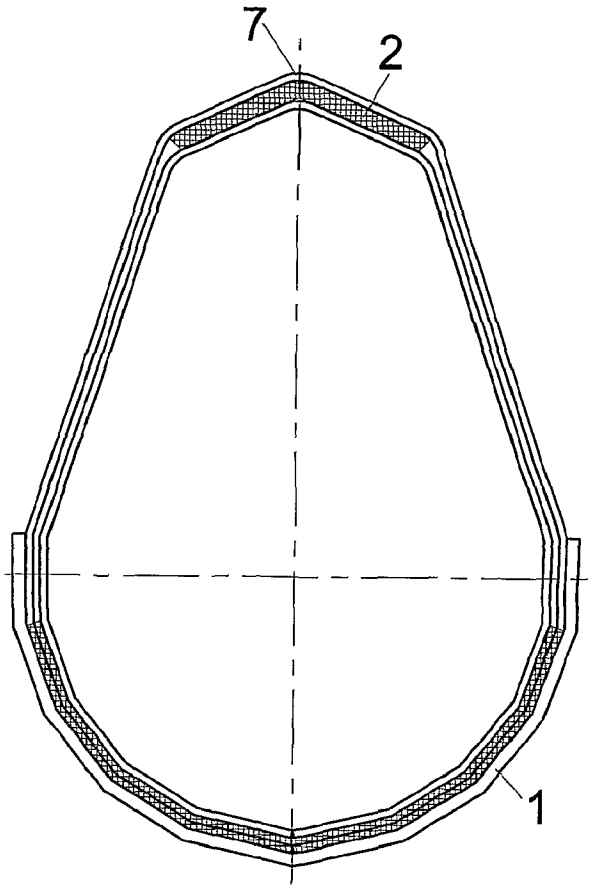
FIG. 1*f* shows a jib system having a jib extension, showing the arrangement of mounting elements.
Figure 1E:
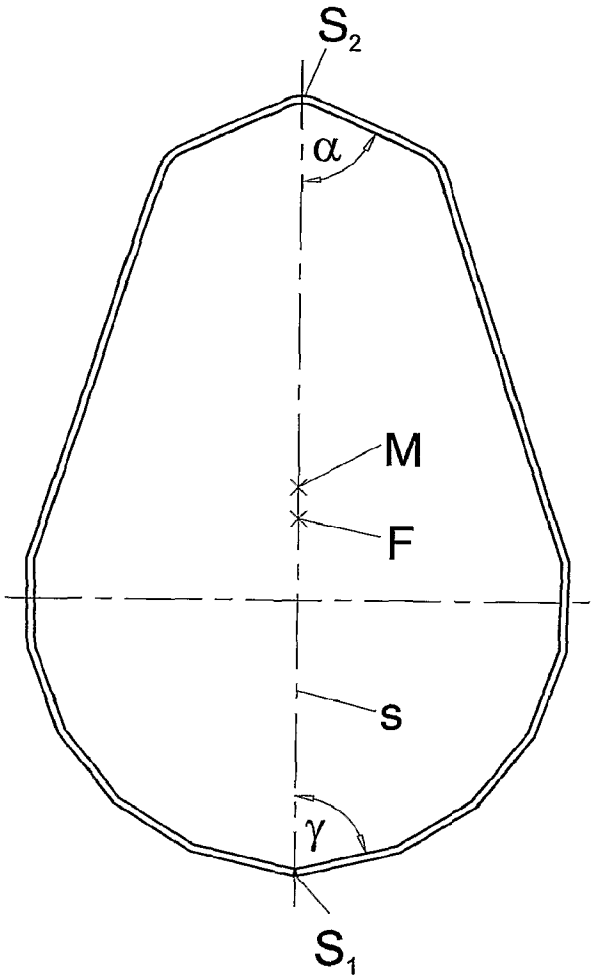
FIG. 1*e* shows the crane boom of FIGS. 1*a* through 1*c*, showing the position of the centroid.

FIG. 1*e* shows for the embodiment of FIG. 1 the position of the centroid F between the center point M and the first intersection point $S_1$ on the axis of symmetry s. In this case, the centroid F refers to the area shown in dash-dotted lines in FIG. 2, that is to say the entire area enclosed by the notional contour line (corresponds to the outside contour).

FIG. 1*f* shows a jib system 5 with a jib extension, showing in addition the mounting of the jib system 5 by way of a mounting element 1 and mounting of the jib extension in the jib by way of mounting elements 2. It will be appreciated that the illustrated embodiment is intended purely by way of example in relation to the number of illustrated jib extensions. The same mounting elements can be used in jib systems having any number of jib extensions.

Figure 1G:
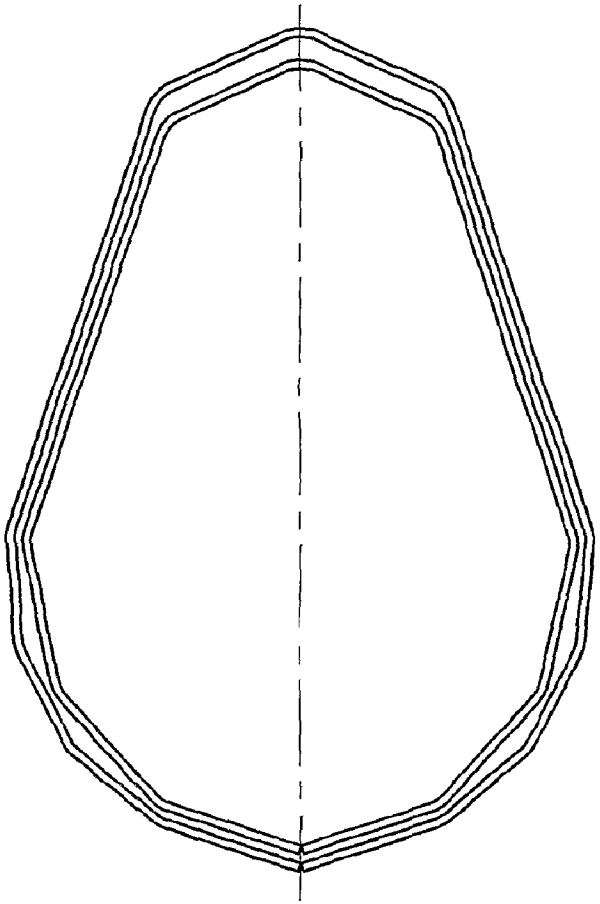
FIG. 1*g* shows a jib system with a jib extension, wherein the arcuate portion in the jib and the jib extension was approximated by different polygons.

The embodiment of FIG. 1*g* shows two crane booms which involve for example a jib extension arranged in a jib. It is of significance that the arcuate portion $k_1$ is approximated by different polygons. The inwardly disposed cross-sectional profile has fewer edges in the region of the arcuate portion, which can be of advantage in particular when dealing with small profiles, in terms of manufacturing technology.

Production of a crane boom according to the invention can be effected for example in such a way that the crane boom is formed from two shells which are shaped in mirror image relationship with each other, wherein one of the shells respectively corresponds to one of the embodiments. The two shells can be joined together, for example welded, in the region of the first intersection point $S_1$ and the second intersection point $S_2$.

It will be noted however that it is particularly preferably provided that the crane boom is produced from a single metal sheet at least along a portion of its longitudinal extent, the metal sheet being suitably shaped and then closed along a single line (for example by welding). That line can extend for example in the region of the first intersection point $S_1$ or the second intersection point $S_2$.

Shaping of the metal sheets can be effected in a known manner or by folding or bending and/or rolling, and for example welding.

If different gauges are required, the outside contour should preferably remain the same and the sheet metal thickness should be applied inwardly.

Figure 4:
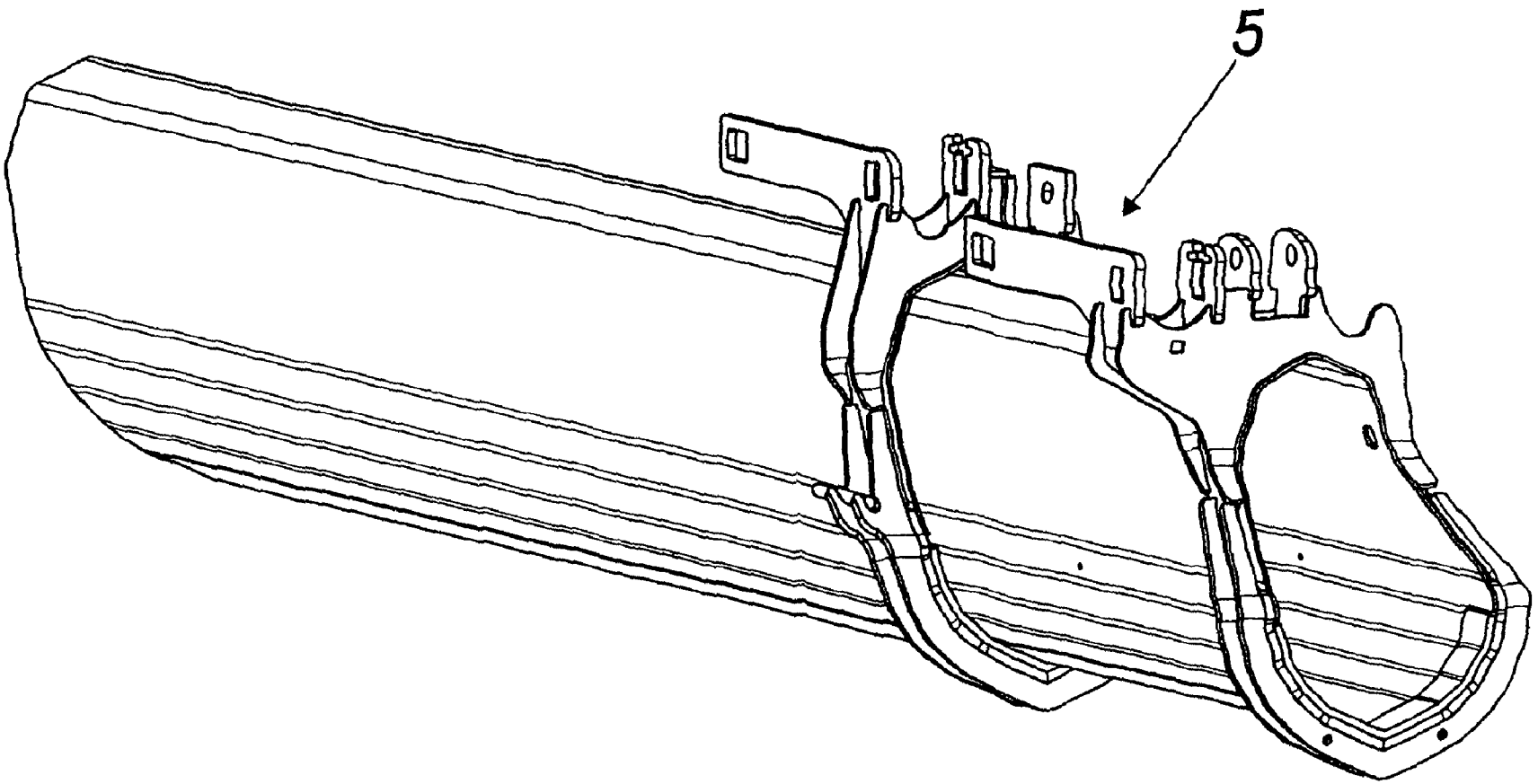
FIG. 4 shows a perspective view of a jib system as shown in FIG. 1*d*.

FIG. 4 shows by way of example a jib system 5 having a jib extension arranged in a jib.

Figure 5:
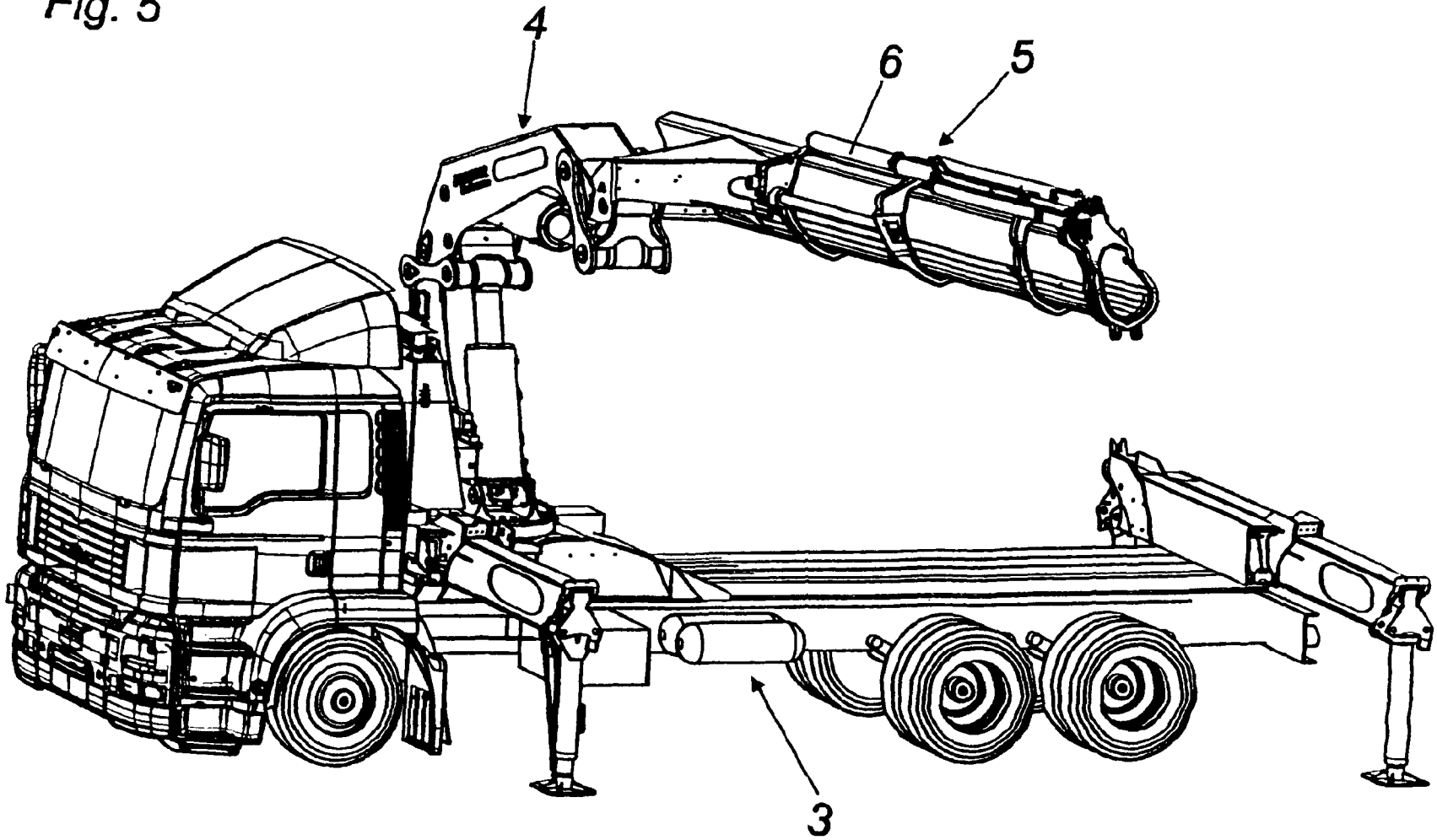
FIG. 5 shows a utility vehicle with a crane according to the invention.

FIG. 5 shows by way of example a utility vehicle 3 on which a crane 4 according to the invention is arranged. The crane 4 has a jib system 5 according to the invention, in which case the individual jib extensions can be telescopically displaced relative to each other by way of thrust cylinders 6. It will be appreciated that telescopic displaceability can also be ensured by other drive means. A loading structure (not shown) could be arranged for example in the rearward region of the utility vehicle 3.

The invention claimed is:

1. A crane boom for a crane, comprising:

a longitudinal axis; and a notional contour line extending within a transverse plane relative to an axis of symmetry such that the contour line is at least approximately mirror-symmetrical with respect to the axis of symmetry, the contour line intersecting the axis of symmetry at a first intersection point and a second intersection point so as to define a center point located on the axis of symmetry equidistant between the first intersection point and the second intersection point;

wherein the contour line has:

an at least approximately arcuate portion between the center point and the first intersection point;

a first straight portion tangentially adjoining the arcuate portion in a direction of the second intersection point, the first straight portion being oriented such that a notional extension of the first straight portion intersects the axis of symmetry with an acute angle therebetween; and a second straight portion tangentially adjoining the arcuate portion in a direction of the first intersection point, the second straight portion being oriented so as to intersect the axis of symmetry at the first intersection point with an angle of less than 90 degrees therebetween.

2. The crane boom of claim 1, wherein the angle between the second straight portion and the axis of symmetry is less than 80 degrees.

3. The crane boom of claim 1, wherein the angle between the second straight portion and the axis of symmetry is greater than 70 degrees.

4. The crane boom of claim 1, wherein the notional extension of the first straight portion forms an acute angle with the axis of symmetry.

5. The crane boom of claim 1, wherein the arcuate portion is shaped as a quarter-circle arc.

6. The crane boom of claim 1, wherein the arcuate portion has a center point of curvature on or in the proximity of the axis of symmetry.

7. The crane boom of claim 1, wherein the arcuate portion has a center point of curvature between the first intersection point and the center point between the first intersection point and the second intersection point.

8. The crane boom of claim 1, wherein each of the first straight portion and the second straight portion is shaped as a tangential extension of the arcuate portion.

9. The crane boom of claim 1, wherein the contour line between the first intersection point and the second intersection point has an extreme point located at a maximum distance from the axis of symmetry.

10. The crane boom of claim 9, wherein a distance between the first intersection point and the second intersection point is at least twice as large as the maximum distance of the extreme point from the axis of symmetry.

11. The crane boom of claim 9, wherein the extreme point is located between the first intersection point and the center point between the first intersection point and the second intersection point.

12. The crane boom of claim 9, wherein a spacing of the contour line from the axis of symmetry at a location approximately a quarter of the distance from the second intersection point toward the first intersection point is less than or equal to 0.8 times the maximum distance.

13. The crane boom of claim 1, wherein the arcuate portion has a shape approximated by a polygon.

14. The crane boom of claim 1, wherein the crane boom has a uniform cross-sectional shape at least over a majority of the longitudinal axis.

15. The crane boom of claim 1, further comprising at least one metal sheet having a substantially uniform metal sheet thickness at all portions of the crane boom with respect to the transverse plane.

16. The crane boom of claim 1, further comprising two shells shaped in a mirror-image relationship with each other and joined to each other.

17. The crane boom of claim 1, further comprising a single metal sheet formed at least along a portion of the longitudinal axis of the crane boom so as to be closed along a single line extending at a region of at least one of the first intersection point and the second intersection point.

18. A jib system for a crane, comprising:

a jib formed as a crane boom, the crane boom comprising:

a longitudinal axis; and a notional contour line extending within a transverse plane relative to an axis of symmetry such that the contour line is at least approximately mirror-symmetrical with respect to the axis of symmetry, the contour line intersecting the axis of symmetry at a first intersection point and a second intersection point so as to define a center point located on the axis of symmetry equidistant between the first intersection point and the second intersection point;

wherein the contour line has:

an at least approximately arcuate portion between the center point and the first intersection point;

a first straight portion tangentially adjoining the arcuate portion in a direction of the second intersection point, the first straight portion being oriented such that a notional extension of the first straight portion intersects the axis of symmetry with an acute angle therebetween; and a second straight portion tangentially adjoining the arcuate portion in a direction of the first intersection point, the second straight portion being oriented so as to intersect the axis of symmetry at the first intersection point with an angle of less than 90 degrees therebetween.

19. The jib system of claim 18, further comprising a jib extension movable with respect to the jib, a shape of the contour line of the jib being substantially identical to a shape of a contour line of the jib extension.

20. A crane comprising:

a crane boom including:

a longitudinal axis; and a notional contour line extending within a transverse plane relative to an axis of symmetry such that the contour line is at least approximately mirror-symmetrical with respect to the axis of symmetry, the contour line intersecting the axis of symmetry at a first intersection point and a second intersection point so as to define a center point located on the axis of symmetry equidistant between the first intersection point and the second intersection point;

wherein the contour line has:

an at least approximately arcuate portion between the center point and the first intersection point;

a first straight portion tangentially adjoining the arcuate portion in a direction of the second intersection point, the first straight portion being oriented such that a notional extension of the first straight portion intersects the axis of symmetry with an acute angle therebetween; and a second straight portion tangentially adjoining the arcuate portion in a direction of the first intersection point, the second straight portion being oriented so as to intersect the axis of symmetry at the first intersection point with an angle of less than 90 degrees therebetween.

21. A utility vehicle comprising:

a crane including:

a crane boom including:

a longitudinal axis; and a notional contour line extending within a transverse plane relative to an axis of symmetry such that the contour line is at least approximately mirror-symmetrical with respect to the axis of symmetry, the contour line intersecting the axis of symmetry at a first intersection point and a second intersection point so as to define a center point located on the axis of symmetry equidistant between the first intersection point and the second intersection point;

wherein the contour line has:

an at least approximately arcuate portion between the center point and the first intersection point;

a first straight portion tangentially adjoining the arcuate portion in a direction of the second intersection point, the first straight portion being oriented such that a notional extension of the first straight portion intersects the axis of symmetry with an acute angle therebetween; and a second straight portion tangentially adjoining the arcuate portion in a direction of the first intersection point, the second straight portion being oriented so as to intersect the axis of symmetry at the first intersection point with an angle of less than 90 degrees therebetween.

22. A loading crane comprising:

a jib system including:

a jib formed as a crane boom, the crane boom comprising:

a longitudinal axis; and a notional contour line extending within a transverse plane relative to an axis of symmetry such that the contour line is at least approximately mirror-symmetrical with respect to the axis of symmetry, the contour line intersecting the axis of symmetry at a first intersection point and a second intersection point so as to define a center point located on the axis of symmetry equidistant between the first intersection point and the second intersection point;

wherein the contour line has:

an at least approximately arcuate portion between the center point and the first intersection point;

a first straight portion tangentially adjoining the arcuate portion in a direction of the second intersection point, the first straight portion being oriented such that a notional extension of the first straight portion intersects the axis of symmetry with an acute angle therebetween; and a second straight portion tangentially adjoining the arcuate portion in a direction of the first intersection point, the second straight portion being oriented so as to intersect the axis of symmetry at the first intersection point with an angle of less than 90 degrees therebetween.

23. The loading crane of claim 22, wherein said jib system further includes a jib extension movable with respect to the jib, a shape of the contour line of the jib being substantially identical to a shape of a contour line of the jib extension.

* * * * *